US006240872B1

(12) United States Patent
Zhou

(10) Patent No.: US 6,240,872 B1
(45) Date of Patent: Jun. 5, 2001

(54) FOLDABLE BOAT

(76) Inventor: Dong Fang Zhou, 1336 1/2 E. Las Tunas Dr., San Gabriel, CA (US) 91776

( * ) Notice: Subject to any disclaimer, the term of this patent is extended or adjusted under 35 U.S.C. 154(b) by 0 days.

(21) Appl. No.: 09/590,536

(22) Filed: Jun. 8, 2000

(51) Int. Cl.[7] ..... B63B 7/00
(52) U.S. Cl. ..... 114/354
(58) Field of Search ..... 114/352–354

(56) References Cited

U.S. PATENT DOCUMENTS 2,271,338 * 1/1942 Hamlin, Jr. ..... 114/354
3,639,933 * 2/1972 Trowbridge ..... 114/354
5,704,310 * 1/1998 Cittadini ..... 114/354

* cited by examiner

*Primary Examiner*—Ed Swinehart
(74) *Attorney, Agent, or Firm*—Raymond Y. Chan; David & Raymond Patent Group

(57) ABSTRACT

A foldable boat includes a bottom panel, a pair of side panels foldably and sealedly affixed on two sides of the bottom panel, and a front and rear elastic panels sealedly attached at a front and rear end of the foldable boat respectively in such a manner in a folded condition, the two side panels are adapted to be folded on top of the bottom panel overlappedly, and in an unfolded condition, the two side panels are adapted to be folded to be disposed perpendicularly with respect to the bottom panel. Moreover, a front and rear supporting frames are respectively mounted between the two side panels, so as to detachably affixed on two front panel edges of the two side panels for rigidly supporting and retaining the two side panels in the unfolded condition.

20 Claims, 7 Drawing Sheets

FOLDABLE BOAT

BACKGROUND OF THE PRESENT INVENTION

1. Field of Invention

The present invention relates to a boat, and more particularly to a foldable boat, which can be quickly and easily folded for carriage and storage and unfolded for use.

2. Description of Related Arts

People, like sports such as boating or fishing, usually own their own boat so that they can go sailing anytime they want. In order to transport the boat, people may need a sport utility vehicle or a van that has already installed a vowing package to rail the boat. The vowing package is separately sold in the car dealer that may cost as much as the boat including the installation. So, people must afford both the cost of the boat and the relatively high cost of its accessories.

Even though people have all the accessories of the boat, they have trouble when they transport their boat. The boat is usually vowed at the back of the vehicle that may increase the length of the vehicle. So, drivers must use their experience to drive the longer vehicle safety, especially when they want to make turns or back up of the vehicle. However, inexperienced people may cause accident because they are not used to drive the longer vehicle as they drive daily.

Furthermore, the vehicle with the vowed boat must occupy the special designated parking space in order to fit the size of the vehicle. However, such designated parking spaces are relatively lacked in the city and are insufficient in the campsite as well. So, finding a parking space is a headache, especially during holiday, for people who just want to have fun and enjoy sailing.

Thus, in such campsite, there is very limited of a designated landing stage that people can drop their boats off the sea. During holiday, people must wait and are lined up to drop off the boat for an hour because individual takes at least 20 minutes to successfully drop off the boat. So, people are mad about paying extra money, finding parking space and waiting to drop off the boat in order to enjoy the sea breeze.

SUMMARY OF THE PRESENT INVENTION

A main object of the present invention is to provide a foldable boat that can be quickly and easily folded into a compact unit for carriage and storage and unfolded for use.

Another object of the present invention is to provide a foldable boat that is relatively lightweight, which can be carried by two people.

Another object of the present invention is to provide a foldable boat that requires simple assembly or disassembly for use or repair.

Another object of the present invention is to provide a foldable boat adapted to be landed into the sea or on the ground anywhere.

Accordingly, in order to accomplish the above objects, the present invention provides a foldable boat, comprising:

a bottom panel having a front edge, a rear edge, and two side edges;

a pair of side panels, each having a front panel edge, a rear panel edge, a top panel edge, and a bottom panel edge;

a connecting means for foldably and sealedly connecting the two bottom panel edges of the two side panels with the two side edges of the bottom panel respectively in such a manner that in a folded condition, the two side panels are adapted to be folded on top of the bottom panel overlappedly, and in an unfolded condition, the two side panels are adapted to be folded to be disposed perpendicularly with respect to the bottom panel;

a front elastic panel having two front panel side brims permanently affixed to two front panel edges of the two side panels respectively and a front panel bottom brim permanently affixed to the front edge of the bottom panel;

a rear elastic panel having two rear panel side brims permanently affixed to two rear panel edges of the two said panels respectively and a rear panel bottom brim permanently affixed to the rear edge of the bottom panel;

a front supporting frame mounted between two front portions of the two side panels, so as to detachably affixed on two front panel edges of the two side panels for rigidly supporting and retaining the two side panels in the unfolded condition; and a rear supporting frame mounted between two rear portions of the two side panels, so as to detachably affixed on two rear panel edges of the two side panels for rigidly supporting and retaining the two side panels in the unfolded condition.

DETAILED DESCRIPTION OF THE PREFERRED EMBODIMENT

Figure 1:
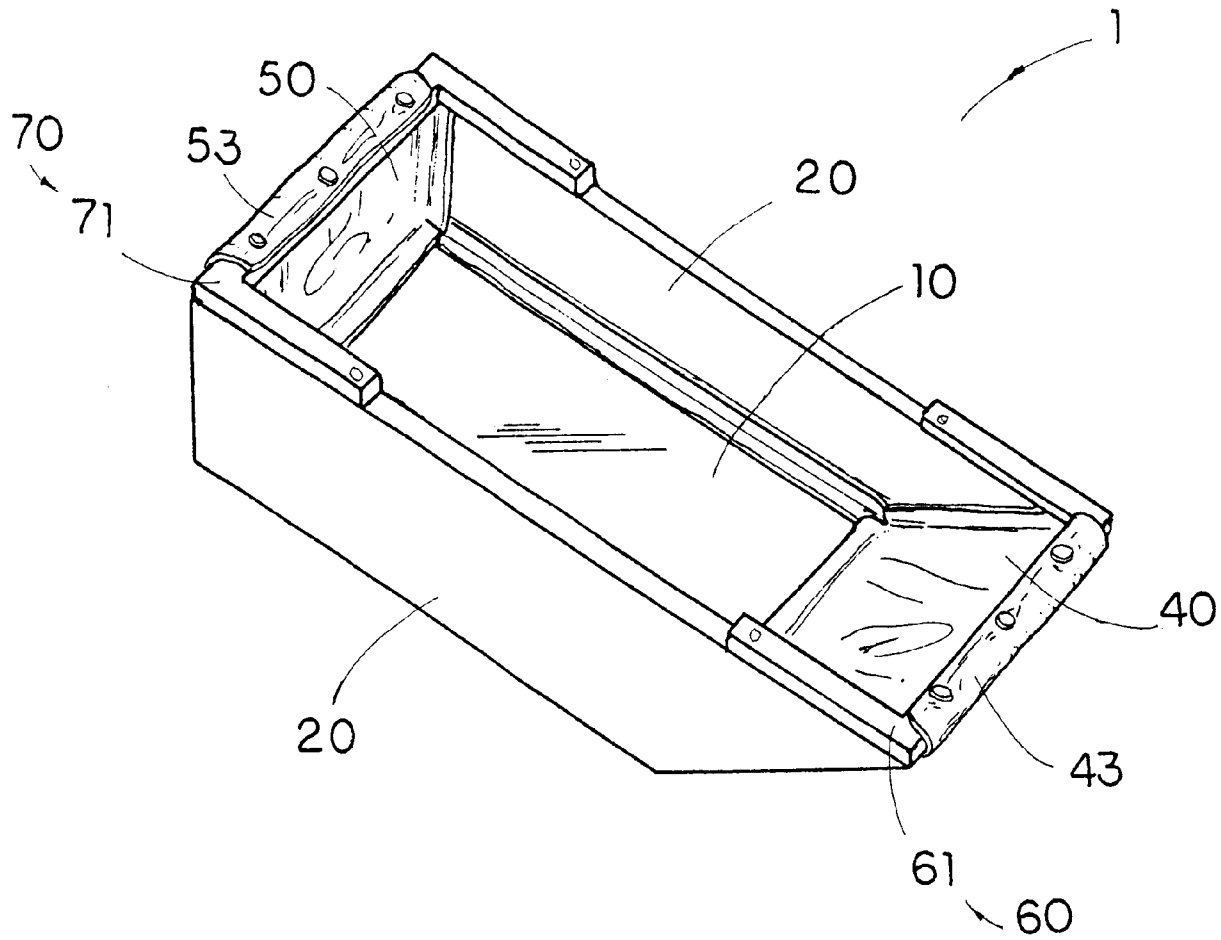
FIG. 1 is a perspective view of a foldable boat according to a first preferred embodiment of the present invention.

Referring to FIG. 1 of the drawings, a foldable boat 1 according to a first preferred embodiment of the present invention is illustrated, which comprises a bottom panel 10, a pair of side panels 20, a connecting means 30, a front elastic panel 40, and a rear elastic panel 50.

Figure 2:
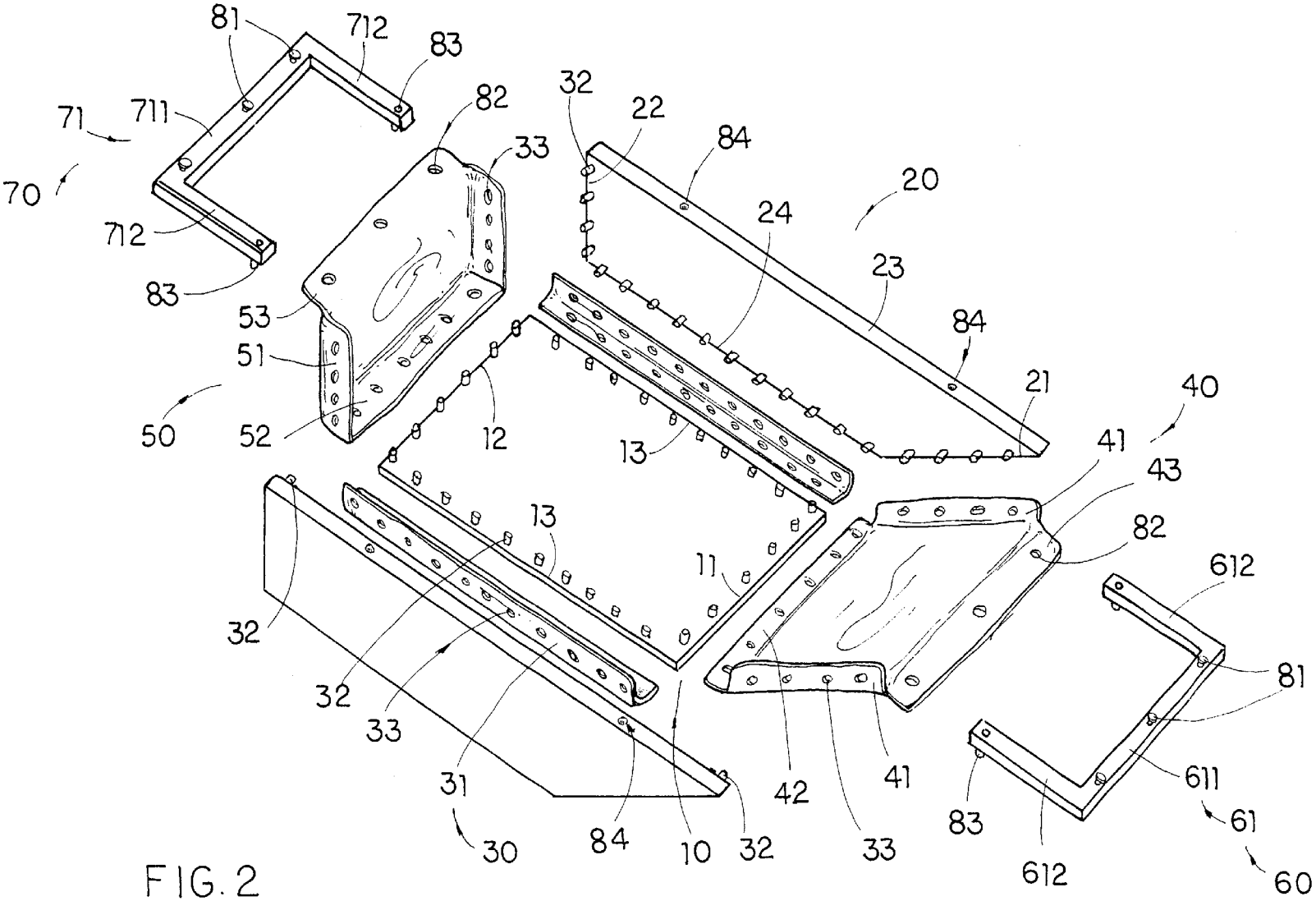
FIG. 2 is an exploded perspective view of the foldable boat according to the above first preferred embodiment of the present invention.

As shown in FIG. 2, the bottom panel 10 has a front edge 11, a rear edge 12, and two side edges 13. Each side panel 20 has a front panel edge 21, a rear panel edge 22, a top panel edge 23, and a bottom panel edge 24. Both the bottom panel 10 and the side panels 20 are made of wood or fabric glass, which are lightweight, floatable, and durable, such that a user is able to carry and repair the bottom panel 10 and the side panels 20 easily.

Figure 3:
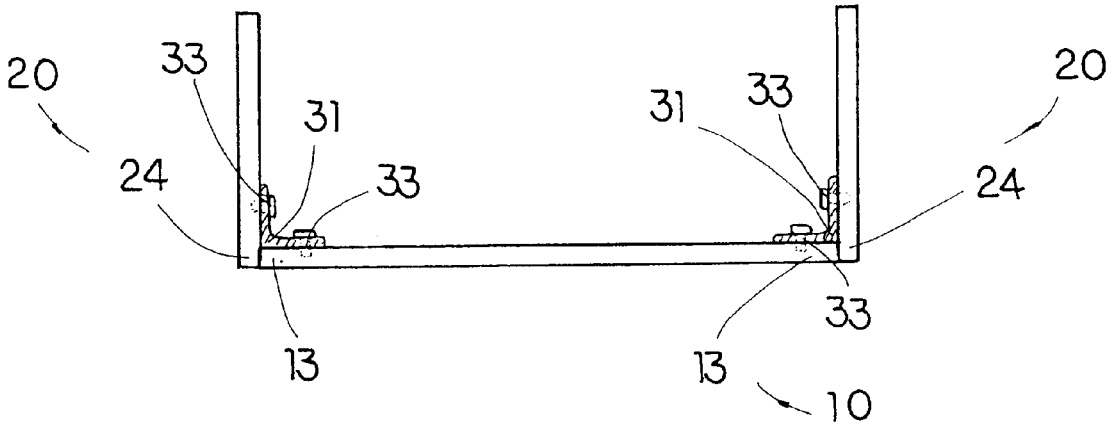
FIG. 3 is a sectional view of the foldable boat according to the above first preferred embodiment of the present invention.
Figure 4B:
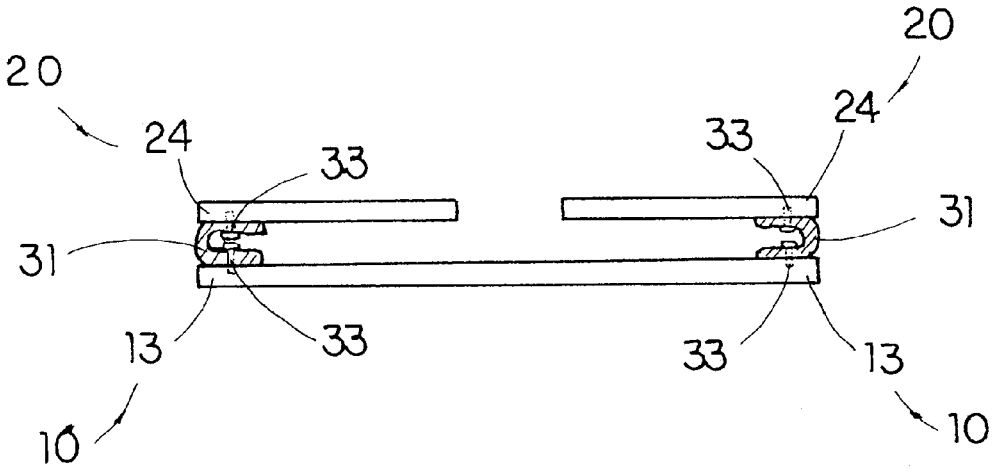
FIG. 4B is a sectional view of the foldable boat in folded state according to the above first preferred embodiment of the present invention.
Figure 4A:
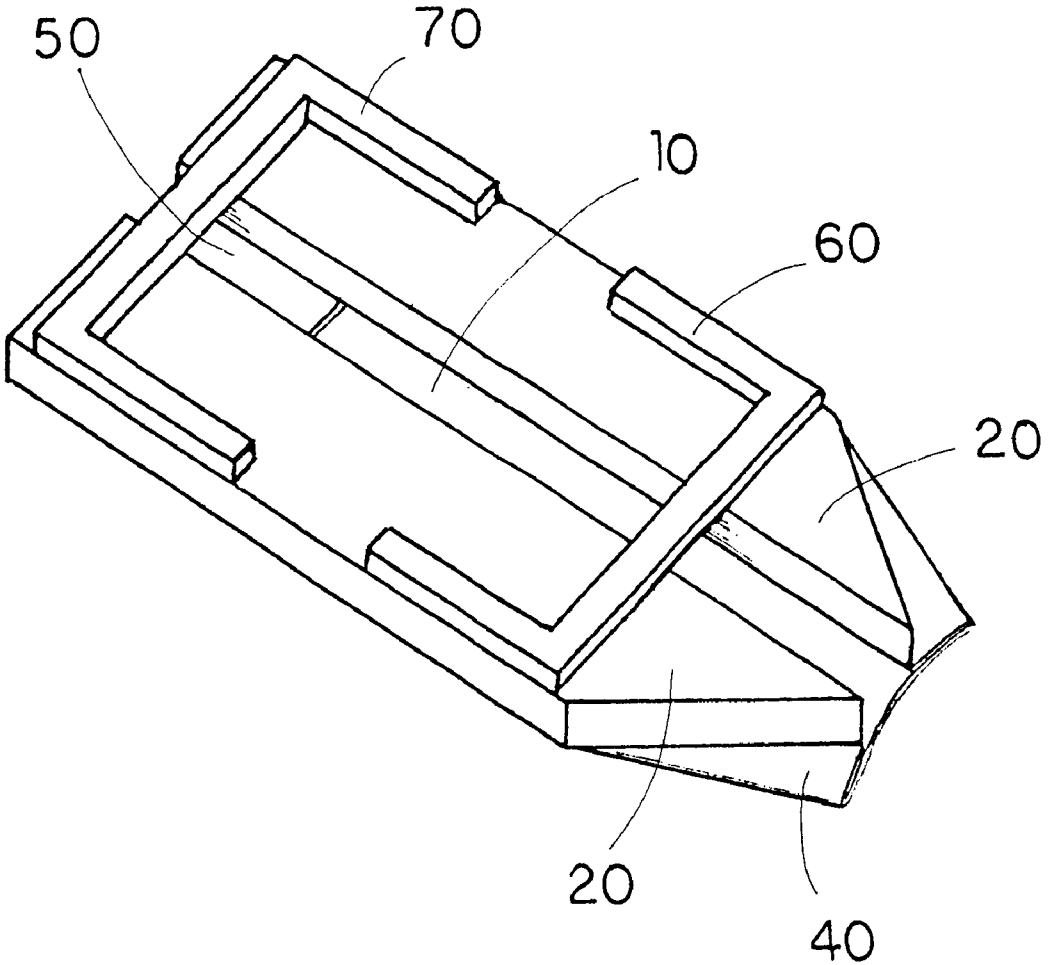
FIG. 4A is a perspective view of the foldable boat in folded state according to the above first preferred embodiment of the present invention.

The connecting means 30 is adapted for foldably and sealedly connecting the two bottom panel edges 24 of the two side panels 20 with the two side edges 13 of the bottom panel 10 respectively in such a manner that in a folded condition, the two side panels 20 are adapted to be folded on top of the bottom panel 10 overlappedly, as shown in FIGS. 4A and 4B, and in an unfolded condition, the two side panels 20 are adapted to be folded and disposed perpendicularly with respect to the bottom panel 10, as shown in FIG. 3.

The connecting means 30 comprises a pair of elastic straps 31, which are made of rubber or PVC, each sealedly affixed along a connecting seam between the bottom panel edge 24 of the side panel 20 with the side edges 13 of the bottom panel 10. Moreover, a plurality of connecting bolts 32 are evenly mounted on the bottom panel edge 24 of the side panel 20 and the side edges 13 of the bottom panel 10 respectively for engaging with a plurality of respective connecting through slits 33 spacedly provided on each elastic strap 31, so as to sealedly affixed the elastic straps 31 between the bottom panel 10 and the side panels 20, for preventing the water from leaking into the foldable boat 1 from a bottom thereof.

The front elastic panel 40 has two front panel side brims 41 permanently affixed to two front panel edges 21 of the two side panels 20 respectively and a front panel bottom brim 42 permanently affixed to the front edge 11 of the bottom panel 10. Also, the rear elastic panel 50 has two rear panel side brims 51 permanently affixed to two rear panel edges 22 of the two said panels 20 respectively, and a rear panel bottom brim 52 permanently affixed to the rear edge 12 of the bottom panel 10.

Both the front and rear elastic panels 40, 50 are made of rubber or PVC having a stretchable, durable and waterproof properties, such that the front and rear panel 40, 50 are adapted to be bendably and overlappedly folded up while the foldable boat 1 is in the folded condition.

Thus, the connecting bolts 32 are also evenly mounted on the two front panel edges 21 and the two rear panel edges 22 of the two side panels 20 and the front edge 11 and the rear edge 12 of the bottom panel 10 respectively for engaging with the respective connecting through slits 33 spacedly provided on the two front panel side brims 41 and the front panel bottom brim 42 of the front elastic panel 40 and the two rear panel side brims 51 and the rear panel bottom brim 52 of the rear elastic panel 50, so as to sealedly affixed the front and rear elastic panels 40, 50 to a front end and a rear end of the foldable boat 1 respectively.

In other words, the connecting bolts 32 are evenly mounted on the front, rear, and side edges 11, 12, 13 of the bottom panel 10 and the front, rear, and bottom panel edges 21, 22, 24 of the side panels 20. The connecting through slits 33 are spacedly provided on the elastic straps 31, the two front panel side brims 41 and the front panel bottom brim 42 of the front elastic panel 40, and the two rear panel side brims 51 and the rear panel bottom brim 52 of the rear elastic panel 50 so as to reinforce the elastic straps 31 and the front and rear elastic panels 40, 50 on the bottom panel 10 and two side panels together for preventing water from entering into the foldable boat 1.

The foldable boat 1 further comprises a front supporting frame 60 and a rear supporting frame 70 for providing a rigid structure of the foldable boat 1. The front supporting frame 60 is mounted between two front portions of the two side panels 20, so as to detachably affixed on two front panel edges 21 of the two side panels 20 for rigidly supporting and retaining the two side panels 20 in the unfolded condition. The rear supporting frame 70 mounted between two rear portions of the two side panels 20, so as to detachably affixed on two rear panel edges 22 of the two side panels 20 for rigidly supporting and retaining the two side panels 20 in the unfolded condition.

The front supporting frame 60 comprises a U-shaped front supporting bar 61 having a front arm 611 and a pair of side arms 612 perpendicularly and integrally extended at two ends of the front arm 611 wherein the two side arms 612 of the front supporting bar 61 are detachably attached on the front portions of the two top panel edges 23 of the two side panels 20 in the unfolded condition in such a manner the front arm 611 of the front supporting bar 61 has a width equal to a distance between two side panels 20 in the unfolded condition, i.e. a width of the foldable boat 1.

The rear supporting frame 70 comprises a U-shaped rear supporting bar 71 having a rear arm 711 and a pair of supporting arms 712 perpendicularly and integrally extended at two ends of the rear arm 711 wherein the two supporting arms 712 of the rear supporting bar 71 are detachably attached on the rear potions of the two top panel edges 23 of the two side panels 20 in the unfolded condition. In other words, the rear supporting bar 71 has a similar structure of the front supporting bar 61 wherein the front and rear supporting bars 61, 71 are respectively supported and retained the two side panels 20 in the unfolded position, so as to hold the two side panels 20 in position and prevent a lateral movement of the two side panels 20 of the foldable boat 1.

In order to mount the front and rear supporting frame 60, 70 on the two side panels 20 in position, the front elastic panel 40 and the rear elastic panel 50 further comprise a front lip 43 integrally extended from a top edge of the front elastic panel 40 and a rear lip 53 integrally extended from a top edge of the rear elastic panel 50 respectively wherein the front lip 43 and the rear lip 53 are adapted to be upwardly flip over to sealedly attached on the front arm 611 of the front supporting bar 61 and the rear arm 711 of the rear supporting bar 71 respectively, as shown in FIG. 1. So, the front lip 43 and the rear lip 53 will not only prevent water entering from the front and back of the foldable boat 1 but also protect the head and the tail of the foldable boat 1 as a bumper so as to absorb a collision force applied on the head and tail of the foldable boat 1.

Figure 5:
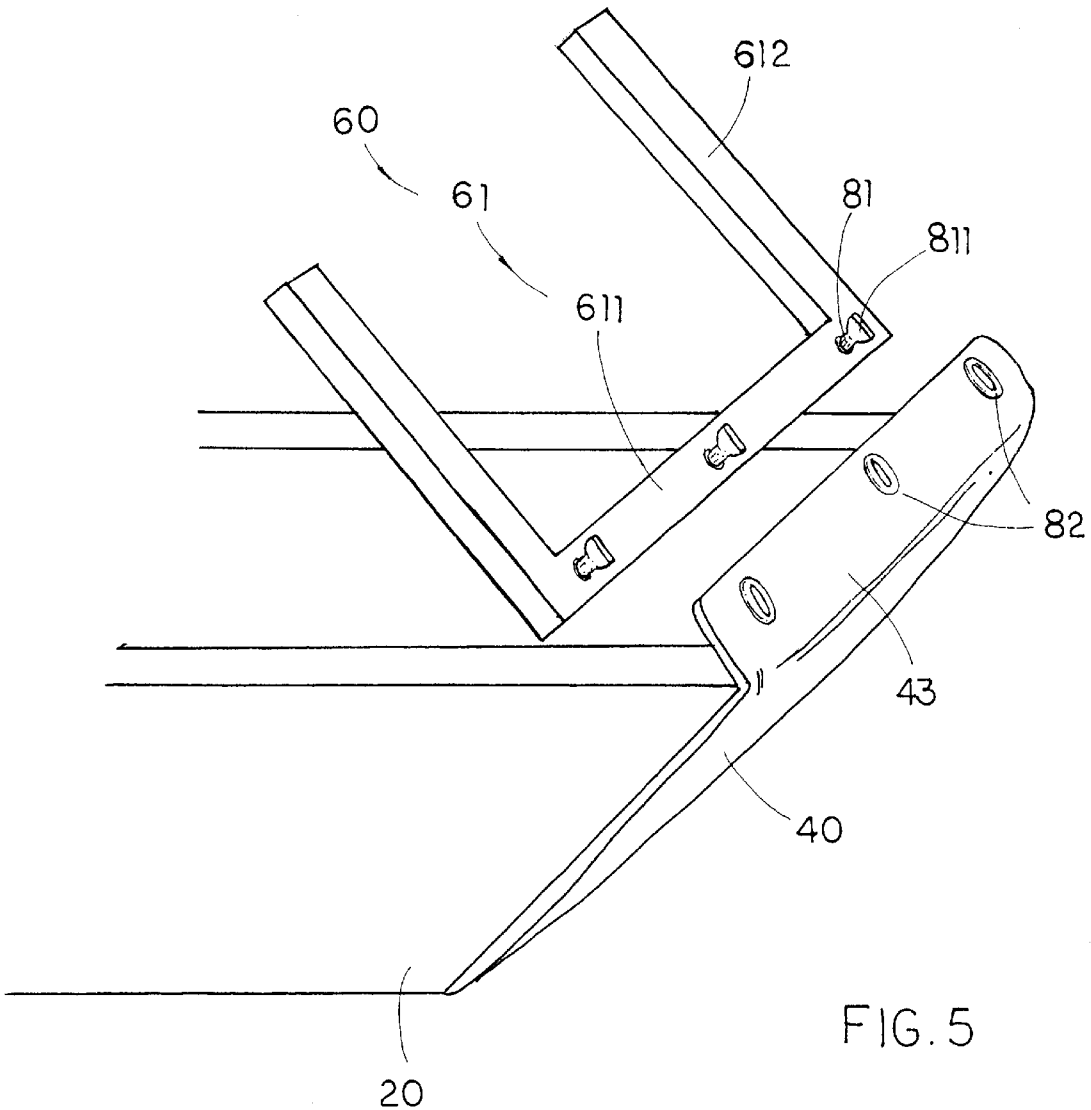
FIG. 5 is a perspective view of the foldable boat according to the above first preferred embodiment of the present invention, illustrating the fastening means for connecting between the front elastic panel and the front supporting frame.

As shown in FIG. 5, the foldable boat I comprises a fastening means 80 for attaching the front and rear supporting frames 60, 70 on the two side panels 20. The fastening means 80 comprises a plurality of mounting projections 81 each having a flat top portion 811 spacedly and rotatably mounted on top of the front arm 611 of the front supporting bar 61 and the rear arm 711 of the rear supporting bar 71 respectively for engaging the respective mounting rings 82 spacedly provided on the front and rear lips 43, 53 of the front and rear elastic panels 40, 50 respectively. Moreover, a locking bolt 83 is provided on each side arm 612 of the front supporting bar 61 and each supporting arm 712 of the rear supporting bar 71 for inserting into a respective locking nut 84 provided on each top panel edge 23 of the side panel 20, so as to lock up the front and rear supporting frame 60, 70 on the two side panels 20.

Figure 6A:
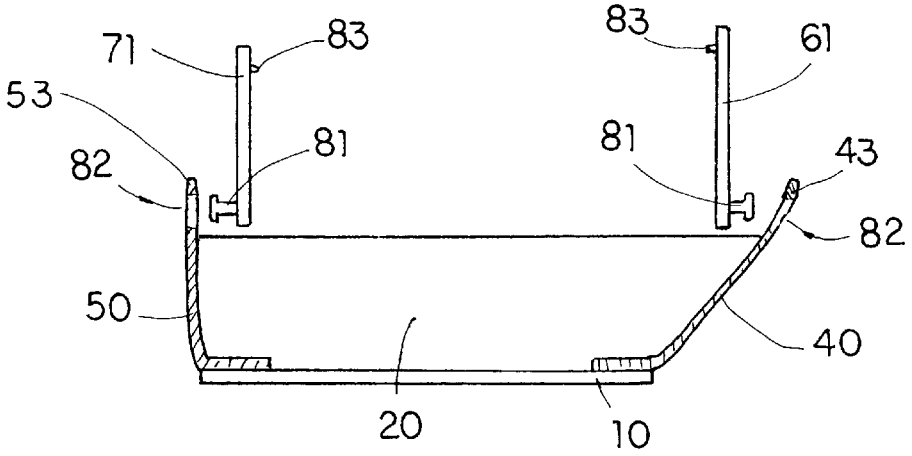
FIGS. 6A to 6C illustrate a mounting process of the front and rear supporting frames of the foldable boat according to the above first preferred embodiment of the present invention.
Figure 6B:
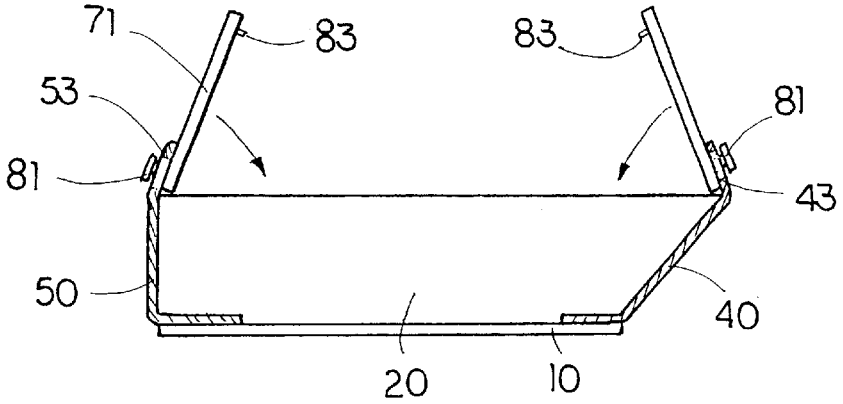
Figure 6C:
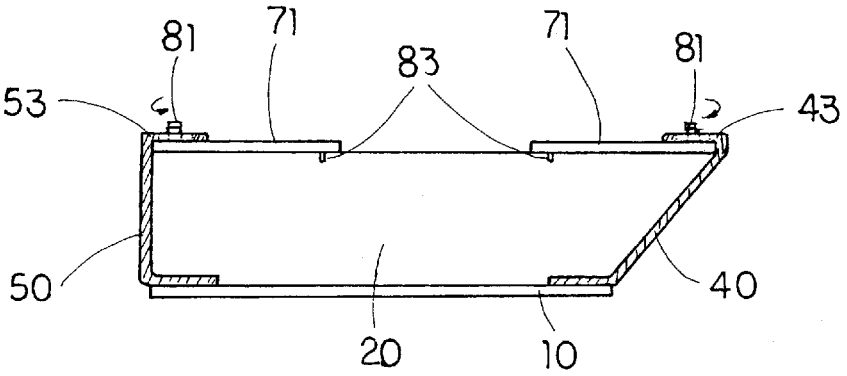

In order to mount the front supporting frame 60 on the side panels 20, as shown in FIGS. 6A through 6C, the mounting projections 81 on the front arm 611 of the front supporting bar 61 are respectively inserted into the mounting rings 82 on the front lip 43 of the front elastic panel 40 and then by pressing the two side arms 612 of the front elastic panel 40 toward to the two side panels 20, the locking bolts 83 on the two respective side arms 612 are adapted to engage with the respective locking nuts 84 on the top panel edges 23 of the side panels 20, so as to lock up the front supporting frames 60 on the two side panels 60 in position. Preferably, each mounting projection 81 is rotated 90 degree such that the flat top portion 811 of the mounting projection 81 is adapted for further locking up the front lip 43 of the front elastic panel 40 on the front supporting frame 60. It is worth to mention that the front lip 43 of the front elastic panel 40 is stretched out while pressing down the front supporting frame 60 in the mounting process as it is mentioned above, the front lip 43 is sealedly affixed on the front supporting frame 60 so as to prevent water from entering into the foldable boat 1 from the front portion thereof. Similarly, the mounting process of the rear supporting frame 70 is the same as that of the front supporting frame 60 such that the foldable boat 1 is rigidly supported by the front and rear supporting frames 60, 70.

Figure 7:
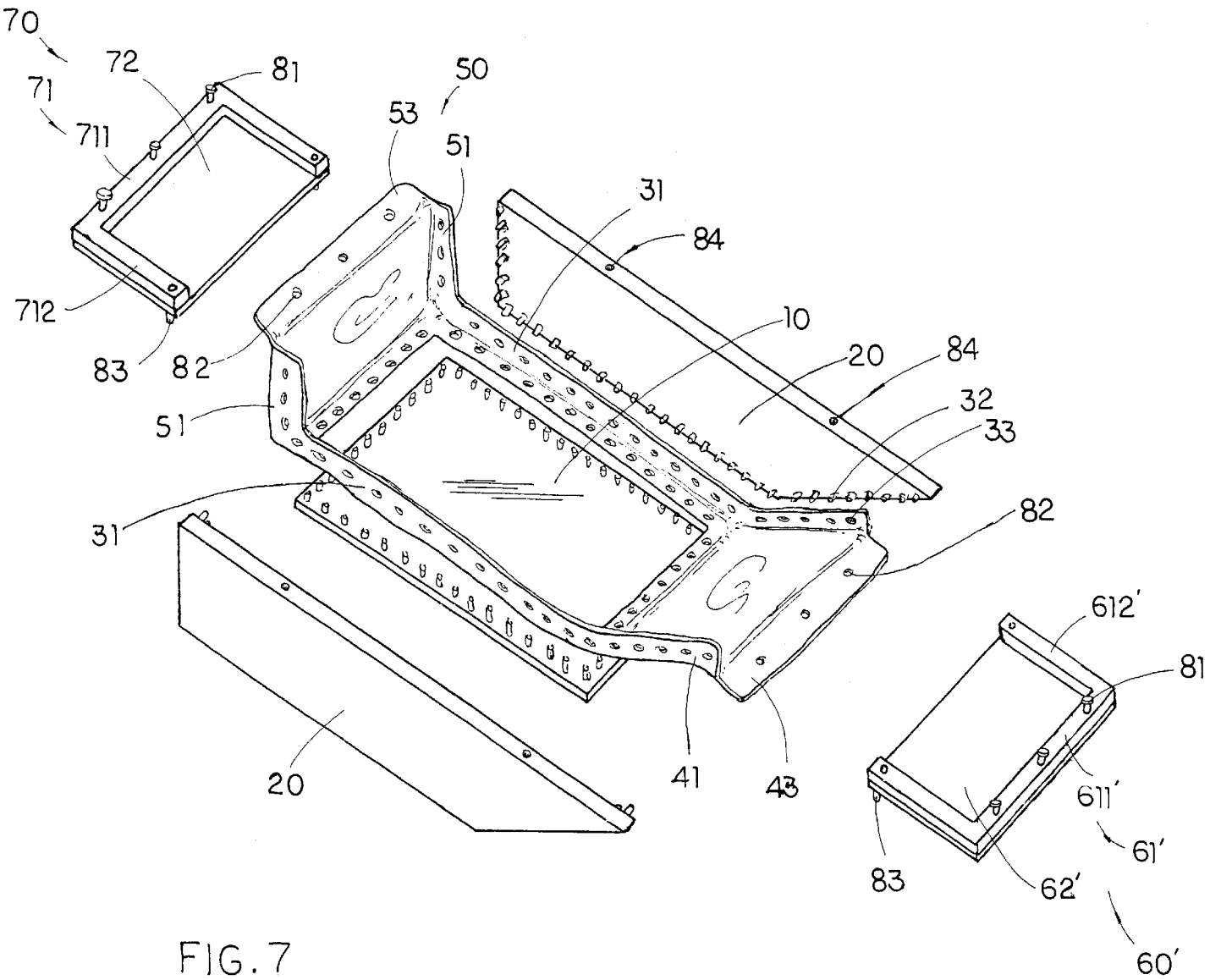
FIG. 7 is a perspective of the foldable boat according to a second preferred embodiment of the present invention.

Referring to FIG. 7, a foldable boat 1' according to a second preferred embodiment of the present invention is illustrated, wherein the pair of elastic straps 31' of the connecting means 30' are integrally extended from the front elastic panel 40' to the rear elastic panel 50'. Moreover, the front and rear supporting frames 60', 70' further comprise a front seat platform 62' and a rear seat platform 72' respectively wherein the front seat platform 62' is affixed on a bottom surface of the front supporting bar 61' and the rear seat platform 72' is affixed on a bottom surface of the rear supporting bar 71', so as to increasing seating areas of the foldable boat 1 for users sitting on the front and rear seat platform 62', 72'.

For further modification, a motor (not shown) is adapted to be installed into the foldable boat 1 such that the foldable boat 1 is adapted to driven by the motor.

In view of the above preferred embodiments, the present invention can be concluded to provide the following advantages.

1. The foldable boat 1 can be folded up in order to highly reduce its size such that the folded foldable boat 1 is adapted to be pull on the top of the vehicle for transportation, unlike the conventional method which is vowed at the back thereof.

2. Since the bottom and side panels 10, 20 are made of lightweight material such as wood or fabric glass and the front and real elastic panels 30, 40 are made of rubber, such that the foldable boat 1 can be easily carried by two people.

3. The repair of the foldable boat 1 is simple and easy. All assembly parts are replaceable and relatively inexpensive wherein a user is able to afford and repair by himself.

4. The foldable boat 1 does not require a designated landing stage in order to land into the sea or on the ground such that the user can use the foldable boat 1 anywhere.

What is claimed is:

1. A foldable boat, comprising:

a bottom panel having a front edge, a rear edge, and two side edges;

a pair of side panels, each of said side panels having a front panel edge, a rear panel edge, a top panel edge, and a bottom panel edge;

a connecting means for foldably and sealedly connecting said two bottom panel edges of said pair of side panels with said two side edges of said bottom panel respectively, wherein during a fold-up condition of said foldable boat, said pair of side panels are arranged being folded on top of said bottom panel overlappedly, and during an unfolded condition of said foldable boat, said pair of side panels are arranged being unfolded perpendicularly with respect to said bottom panel;

a front elastic panel having two front panel side brims permanently affixed to said two front panel edges of said pair of side panels respectively and a front panel bottom brim permanently affixed to said front edge of said bottom panel;

a rear elastic panel having two rear panel side brims permanently affixed to said two rear panel edges of said pair of said side panels respectively and a rear panel bottom brim permanently affixed to said rear edge of said bottom panel;

a front supporting frame mounted between two front portions of said pair of side panels, wherein said front supporting frame is detachably affixed on said two front panel edges of said pair of side panels for rigidly supporting and retaining said pair of side panels in said unfolded condition; and a rear supporting frame mounted between two rear portions of said pair of side panels, wherein said rear supporting frame is detachably affixed on said two rear panel edges of said pair of side panels for rigidly supporting and retaining said pair of side panels in said unfolded condition.

2. A foldable boat, as recited in claim 1, wherein said connecting means comprises a pair of elastic straps, said pair of elastic straps being sealedly affixed respectively along two connecting seams provided between said two bottom panel edge of said pair of side panels and said two side edges of said bottom panel.

3. A foldable boat, as recited in claim 2, wherein said pair of elastic straps is integrally extended from said front elastic panel to said rear elastic panel.

4. A foldable boat, as recited in claim 1, further comprising a plurality of connecting bolts, which are mounted along said front side edge, said rear side edge, and said two side edges of said bottom panel and said front panel edge, said rear panel edge, and said bottom panel edges of said pair of side panels, so as to reinforce said elastic straps and said front and rear elastic panels on said bottom panel and said two side panels together for preventing water from entering into said foldable boat.

5. A foldable boat, as recited in claim 2, further comprising a plurality of connecting bolts, which are mounted along said front side edge, said rear side edge, and said two side edges of said bottom panel and said front panel edge, said rear panel edge, and said bottom panel edges of said pair of side panels, wherein said connecting bolts are respectively engaged with a plurality of connecting through slits spacedly provided on said pair of elastic straps, said two front panel side brims and said front panel bottom brim of said front elastic panel, and said two rear panel side brims and said rear panel bottom brim of said rear elastic panel respectively, so as to reinforce said elastic straps and said front and rear elastic panels on said bottom panel and said two side panels together for preventing water from entering into said foldable boat.

6. A foldable boat, as recited in claim 3, further comprising a plurality of connecting bolts, which are mounted along said front side edge, said rear side edge, and said two side edges of said bottom panel and said front panel edge, said rear panel edge, and said bottom panel edges of said pair of side panels, wherein said connecting bolts are respectively engaged with a plurality of connecting through slits spacedly provided on said pair of elastic straps, said two front panel side brims and said front panel bottom brim of said front elastic panel, and said two rear panel side brims and said rear panel bottom brim of said rear elastic panel respectively, so as to reinforce said elastic straps and said front and rear elastic panels on said bottom panel and said two side panels together for preventing water from entering into said foldable boat.

7. A foldable boat, as recited in claim 1, wherein said front supporting frame comprises a U-shaped front bar and said rear supporting frame comprises a U-shaped rear supporting bar, said front supporting frame having a front arm and a pair of side arms perpendicularly and integrally extended at two ends of said front arm, said rear supporting frame having a rear arm and a pair of supporting arms perpendicularly and integrally extended at two ends of said rear arm, wherein in said unfolded condition, said two side arms of said front supporting frame are detachably attached on said two front portions of said two top panel edges of said pair of side panels and said two side arms of said rear supporting frame are detachably attached on said two rear portions of said two top panel edges of said pair of side panels, wherein each of said front arm of said front supporting frame and said rear arm of said rear supporting frame has a width equal to a distance between said pair of side panels in said unfolded condition.

8. A foldable boat, as recited in claim 2, wherein said front supporting frame comprises a U-shaped front bar and said rear supporting frame comprises a U-shaped rear supporting bar, said front supporting frame having a front arm and a pair of side arms perpendicularly and integrally extended at two ends of said front arm, said rear supporting frame having a rear arm and a pair of supporting arms perpendicularly and integrally extended at two ends of said rear arm, wherein in said unfolded condition, said two side arms of said front supporting frame are detachably attached on said two front portions of said two top panel edges of said pair of side panels and said two side arms of said rear supporting frame are detachably attached on said two rear portions of said two top panel edges of said pair of side panels, wherein each of said front arm of said front supporting frame and said rear arm of said rear supporting frame has a width equal to a distance between said pair of side panels in said unfolded condition.

9. A foldable boat, as recited in claim 5, wherein said front supporting frame comprises a U-shaped front bar and said rear supporting frame comprises a U-shaped rear supporting bar, said front supporting frame having a front arm and a pair of side arms perpendicularly and integrally extended at two ends of said front arm, said rear supporting frame having a rear arm and a pair of supporting arms perpendicularly and integrally extended at two ends of said rear arm, wherein in said unfolded condition, said two side arms of said front supporting frame are detachably attached on said two front portions of said two top panel edges of said pair of side panels and said two side arms of said rear supporting frame are detachably attached on said two rear portions of said two top panel edges of said pair of side panels, wherein each of said front arm of said front supporting frame and said rear arm of said rear supporting frame has a width equal to a distance between said pair of side panels in said unfolded condition.

10. A foldable boat, as recited in claim 6, wherein said front supporting frame comprises a U-shaped front bar and said rear supporting frame comprises a U-shaped rear supporting bar, said front supporting frame having a front arm and a pair of side arms perpendicularly and integrally extended at two ends of said front arm, said rear supporting frame having a rear arm and a pair of supporting arms perpendicularly and integrally extended at two ends of said rear arm, wherein in said unfolded condition, said two side arms of said front supporting frame are detachably attached on said two front portions of said two top panel edges of said pair of side panels and said two side arms of said rear supporting frame are detachably attached on said two rear portions of said two top panel edges of said pair of side panels, wherein each of said front arm of said front supporting frame and said rear arm of said rear supporting frame has a width equal to a distance between said pair of side panels in said unfolded condition.

11. A foldable boat, as recited in claim 7, wherein said front elastic panel further comprises a front lip integrally extended from a top edge of said front elastic panel and said rear elastic panel further comprises a rear lip integrally extended from a top edge of said rear elastic panel, wherein said front lip and said rear lip are upwardly flipped over to sealedly attach on said front arm of said front supporting frame and said rear arm of said rear supporting frame respectively.

12. A foldable boat, as recited in claim 9, wherein said front elastic panel further comprises a front lip integrally extended from a top edge of said front elastic panel and said rear elastic panel further comprises a rear lip integrally extended from a top edge of said rear elastic panel, wherein said front lip and said rear lip are upwardly flipped over to sealedly attach on said front arm of said front supporting frame and said rear arm of said rear supporting frame respectively.

13. A foldable boat, as recited in claim 10, wherein said front elastic panel further comprises a front lip integrally extended from a top edge of said front elastic panel and said rear elastic panel further comprises a rear lip integrally extended from a top edge of said rear elastic panel, wherein said front lip and said rear lip are upwardly flipped over to sealedly attach on said front arm of said front supporting frame and said rear arm of said rear supporting frame respectively.

14. A foldable boat, as recited in claim 11, further comprising a plurality of mounting projections spacedly mounted on top of said front arm of said front supporting frame and said rear arm of said rear supporting frame respectively for engaging a plurality of mounting rings which are spacedly provided on said front lip of said front elastic panel and said rear lip of said front and rear elastic panel, wherein a plurality of locking bolts are spacedly provided on each of said side arms of said front supporting frame and each of said side arms of said rear supporting frame in order to insert into a plurality of locking nuts provided on said two top panel edges of said pair of side panels, so as to lock up said front and rear supporting frames on said pair of side panels.

15. A foldable boat, as recited in claim 12, further comprising a plurality of mounting projections spacedly mounted on top of said front arm of said front supporting frame and said rear arm of said rear supporting frame respectively for engaging a plurality of mounting rings which are spacedly provided on said front lip of said front elastic panel and said rear lip of said front and rear elastic panel, wherein a plurality of locking bolts are spacedly provided on each of said side arms of said front supporting frame and each of said side arms of said rear supporting frame in order to insert into a plurality of locking nuts provided on said two top panel edges of said pair of side panels, so as to lock up said front and rear supporting frames on said pair of side panels.

16. A foldable boat, as recited in claim 13, further comprising a plurality of mounting projections spacedly mounted on top of said front arm of said front supporting frame and said rear arm of said rear supporting frame respectively for engaging a plurality of mounting rings which are spacedly provided on said front lip of said front elastic panel and said rear lip of said front and rear elastic panel, wherein a plurality of locking bolts are spacedly provided on each of said side arms of said front supporting frame and each of said side arms of said rear supporting frame in order to insert into a plurality of locking nuts provided on said two top panel edges of said pair of side panels, so as to lock up said front and rear supporting frames on said pair of side panels.

17. A foldable boat, as recited in claim 10, wherein said front supporting frame further comprises a front seat platform and said rear supporting frame further comprises a rear seat platform, wherein said front seat platform is affixed on a bottom surface of said front supporting frame and said rear seat platform is affixed on a bottom surface of said rear supporting frame.

18. A foldable boat, as recited in claim 11, wherein said front supporting frame further comprises a front seat platform and said rear supporting frame further comprises a rear seat platform, wherein said front seat platform is affixed on a bottom surface of said front supporting frame and said rear seat platform is affixed on a bottom surface of said rear supporting frame.

19. A foldable boat, as recited in claim 13, wherein said front supporting frame further comprises a front seat platform and said rear supporting frame further comprises a rear seat platform, wherein said front seat platform is affixed on a bottom surface of said front supporting frame and said rear seat platform is affixed on a bottom surface of said rear supporting frame.

20. A foldable boat, as recited in claim 16, wherein said front supporting frame further comprises a front seat platform and said rear supporting frame further comprises a rear seat platform, wherein said front seat platform is affixed on a bottom surface of said front supporting frame and said rear seat platform is affixed on a bottom surface of said rear supporting frame.

* * * * *